US009112334B2

(12) United States Patent
Farrell

(10) Patent No.: US 9,112,334 B2
(45) Date of Patent: Aug. 18, 2015

(54) SPARK PLUG CONSTRUCTION

(75) Inventor: Mark Farrell, Etobicoke (CA)

(73) Assignee: Nano Spark Inc., Ontario (CA)

( * ) Notice: Subject to any disclaimer, the term of this patent is extended or adjusted under 35 U.S.C. 154(b) by 0 days.

(21) Appl. No.: 14/233,522

(22) PCT Filed: Oct. 24, 2011

(86) PCT No.: PCT/CA2011/001184

§ 371 (c)(1),
(2), (4) Date: Apr. 28, 2014

(87) PCT Pub. No.: WO2013/010246

PCT Pub. Date: Jan. 24, 2013

(65) Prior Publication Data

US 2015/0035427 A1 Feb. 5, 2015

Related U.S. Application Data

(60) Provisional application No. 61/509,270, filed on Jul. 19, 2011.

(51) Int. Cl.

| | |
|---|---|
| ***H01T 13/32*** | (2006.01) |
| ***H01T 13/20*** | (2006.01) |
| ***H01T 13/26*** | (2006.01) |
| ***H01T 13/46*** | (2006.01) |
| ***H01T 21/06*** | (2006.01) |

(52) U.S. Cl.
CPC ..... *H01T 13/20* (2013.01); *H01T 13/26* (2013.01); *H01T 13/32* (2013.01); *H01T 13/467* (2013.01); *H01T 21/06* (2013.01)

(58) Field of Classification Search
CPC ..... H01T 13/20; H01T 13/32; H01T 13/467; H01T 21/06; H01T 13/26
USPC ..... 313/118, 140, 141, 143; 445/7
See application file for complete search history.

(56) References Cited

U.S. PATENT DOCUMENTS

| | | | |
|---|---|---|---|
| 5,731,654 | A | 3/1998 | Benedikt et al. |
| 2009/0140623 | A1 | 6/2009 | Ugalde |

(Continued)

FOREIGN PATENT DOCUMENTS

| | | | |
|---|---|---|---|
| EP | 0069993 | A1 | 10/1986 |

OTHER PUBLICATIONS

International Search Report and Written Opinion for PCT/CA2011/001184, dated Mar. 7, 2012.

(Continued)

*Primary Examiner* — Joseph L Williams
(74) *Attorney, Agent, or Firm* — Gifford, Krass, Sprinkle, Anderson & Citkowski, P.C.

(57) ABSTRACT

A spark plug is disclosed and comprises: a metal tube which interiorly defines an axis and is externally-threaded for engine block engagement; an insulator having a portion which is disposed inside the tube and extends therebeyond; a positive electrode extending through the insulator and projecting beyond the extending portion of the insulator; and an annular ground electrode coupled to the tube. The electrodes are configured such that a spark gap defined therebetween comprises an elongate channel which opens axially and away from said insulator and is substantially unobstructed in the axial direction. The ground defines a void having: a central portion occupied by the positive electrode in use; an annular channel surrounding the central portion; and a plurality of lobes, each being positioned with respect to the central portion in a manner analogous to the placement of the planet gears with respect to the sun gear in a planetary gear.

2 Claims, 25 Drawing Sheets

(56) References Cited

U.S. PATENT DOCUMENTS

| | | | |
|---|---|---|---|
| 2009/0241321 | A1 | 10/2009 | Farrell et al. |
| 2010/0133976 | A1 | 6/2010 | Siegel |
| 2011/0025186 | A1 | 2/2011 | Kunitomo et al. |
| 2011/0071874 | A1 | 3/2011 | Schneersohn et al. |

OTHER PUBLICATIONS

Extended European Search Report CTM Application No. 11869542.8-1801/2735065 PCT/CA2011001184 dated Oct. 22, 2014.

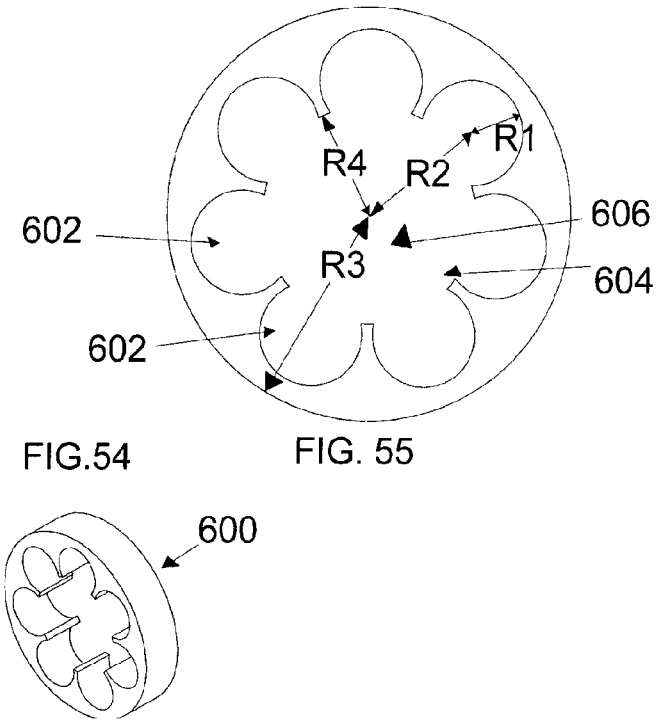
FIG.54
FIG. 55
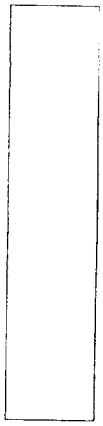
FIG. 56

SPARK PLUG CONSTRUCTION

FIELD OF THE INVENTION

The present invention relates to spark-ignited internal combustion engines.

BACKGROUND OF THE INVENTION

In internal combustion engines, it is conventional to initiate combustion with the use of spark plugs. In conventional spark plugs, a body which defines a longitudinal axis is provided. The body has, adjacent one end thereof, a metal ring which is orientated coaxially with the longitudinal axis. The body further includes a metal tube which: is orientated coaxially with the longitudinal axis; extends from the ring towards the other end of the body; and is externally-threaded for engagement in a corresponding threaded bore in an engine block in use. A porcelain insulator also forms part of the body. The insulator has a portion disposed inside the tube. This portion extends axially, from inside the tube, beyond the ring, and has an elongate void extending axially therethrough. An elongate positive electrode occupies the void and extends axially beyond the insulator to a terminus which defines the one end of the body. Conventional spark plugs also include an electrode leg. The electrode leg has two arms transversely connected to one another, with one arm extending axially from the ring and beyond the electrode and the other arm extending radially inwardly from the one arm so as to terminate in an end portion that is axially-spaced from the terminus. The spark gap in this conventional plug is the space defined between the positive electrode and the electrode leg, this gap being substantially entirely obstructed in the axial direction by the electrode leg.

SUMMARY OF THE INVENTION

An adapter for use with a spark plug body and an engine block forms one aspect of the invention. The plug body defines a longitudinal axis and has: adjacent one end, a metal ring which is orientated coaxially with the longitudinal axis; a metal tube which is orientated coaxially with the longitudinal axis, extends from the ring towards the other end of said body and is externally-threaded for engagement in a corresponding threaded bore in said engine block in use; an insulator having a portion disposed inside the tube, which portion extends axially, from inside the tube, beyond the ring, and has an elongate void extending axially therethrough; and an elongate positive electrode which occupies the void and extends axially beyond the insulator to a terminus which defines the one end of said body. The adapter:

- is secured, in use, to said body;
- comprises: a positive electrode extender which, in use, is in electrically-conducting contacting relation to the positive electrode; and a ground electrode extender which, in use, is in electrically-conducting contacting relation to the metal ring; and
- is configured such that a spark gap defined between the positive and ground electrode extenders comprises an elongate channel which opens axially and away from said body and is substantially unobstructed in the axial direction.

According to another aspect of the invention, in the adapter for use with a spark plug body and an engine block, the ground electrode extender can comprise a fixed portion that is welded to the ring, thereby to secure the adapter to said body and hold the positive electrode extender in said electrically-conducting contacting relation to the positive electrode.

According to another aspect of the invention, in the adapter for use with a spark plug body and an engine block, the ground electrode extender can: further comprise a remote portion that is spaced apart from the fixed portion and from the ring; and be configured such that a spark gap defined between the positive electrode extender and the ground electrode extender comprises an elongate channel defined between the positive electrode extender and the remote portion of the ground electrode extender, which elongate channel opens axially and away from the body and is substantially unobstructed in the axial direction.

According to another aspect of the invention, in the adapter for use with a spark plug body and an engine block, the positive electrode extender can comprise a radially extending bar and the ground electrode extender can comprise four elongate electrode portions, each orientated parallel to the positive electrode extender, with two of the elongate portions disposed on each radial side of the bar and spaced with respect to the bar and one another such that the spark gap comprises four parallel channels, the innermost pair of flanking electrode portions defining the remote portion of the ground electrode extender and the outermost pair of flanking electrode portions forming part of the fixed portion.

According to another aspect of the invention, in the adapter for use with a spark plug body and an engine block, the adapter can further comprise an insulator disposed between and secured to each of: the fixed portion of the ground electrode extender; and the radially extending bar and the remote portion of the ground electrode extender.

According to another aspect of the invention, in the adapter for use with a spark plug body and an engine block, the radially extending bar can project axially beyond the remote portion of the ground electrode extender.

According to another aspect of the invention, in the adapter for use with a spark plug body and an engine block, in the ground electrode extender, the remote portion can project axially beyond the fixed portion.

According to another aspect of the invention, in the adapter for use with a spark plug body and an engine block:

- the fixed portion can be a tube-like extension of the ring;
- the remote portion can comprise: an inner ring, disposed about and in spaced relation to the positive electrode extender and orientated coaxially with the longitudinal axis; and an outer ring, disposed about and in spaced relation to the inner ring, orientated coaxially with the longitudinal axis and disposed in spaced relation to the fixed portion; and
- the spark gap defined between the positive and ground electrode extenders can comprise (i) an annular channel between the positive electrode extender and the inner ring, which opens axially and away from the body and is substantially unobstructed in the axial direction; (ii) an annular channel between the inner ring and the outer ring, which opens axially and away from the body and is substantially unobstructed in the axial direction; and (iii) an annular channel between the outer ring and the fixed portion.

According to another aspect of the invention, in the adapter for use with a spark plug body and an engine block, the spark plug body can further comprise an annular insulator disposed between and secured to each of (i) the fixed portion; and (ii) the inner and outer rings, the outer diameter of the insulator being smaller than the outer diameter of the outer ring, to provide said annular channel between the outer ring and the fixed portion.

According to another aspect of the invention, in the adapter for use with a spark plug body and an engine block, the positive electrode extender can project axially beyond the inner ring.

According to another aspect of the invention, in the adapter for use with a spark plug body and an engine block, the inner ring can project axially beyond the outer ring.

An adapter for use with a spark plug and an engine block forms another aspect of the invention. The spark plug is of the type having a spark plug body and an electrode leg. The spark plug body defines a longitudinal axis and has: adjacent one end, a metal ring which is orientated coaxially with the longitudinal axis; a metal tube which is orientated coaxially with the longitudinal axis, extends from the ring towards the other end of the body and is externally-threaded for engagement in a corresponding threaded bore in said engine block in use; an insulator having a portion disposed inside the tube which portion extends axially, from inside the tube, beyond the ring, and has an elongate void extending axially therethrough; and an elongate positive electrode which occupies the void and extends axially beyond the insulator to a terminus which defines the one end of the body. The electrode leg has two arms transversely connected to one another, with one arm extending axially from the ring and beyond the electrode and the other arm extending radially inwardly from the one arm so as to terminate in an end portion that is axially-spaced from the terminus. The adapter is secured, in use, to said body and comprises: a positive electrode extender which, in use, is in electrically-conducting contacting relation to the positive electrode; and a ground electrode extender which, in use, is in electrically-conducting contacting relation to the electrode leg. The adapter is configured such that a spark gap defined between the positive and ground electrode extenders comprises an elongate channel which opens axially away from the body and is substantially unobstructed in the axial direction.

According to another aspect of the invention, the adapter for use with a spark plug and an engine block can be adapted for snap-fit engagement with said spark plug for use.

According to another aspect of the invention, in the adapter for use with a spark plug and an engine block, the positive electrode extender can comprise a resilient clip portion, said clip portion being defined by an open loop which has an opening smaller than the diameter of the positive electrode, which loop, for use, is orientated such that its opening presents towards the positive electrode and urged radially between the electrode leg and the positive electrode, to allow the positive electrode to enter the loop and provide for said snap-fit engagement.

According to another aspect of the invention, in the adapter for use with a spark plug and an engine block, for use, the loop can be urged towards the one arm of the electrode leg.

According to another aspect of the invention, the adapter for use with a spark plug and an engine block can further comprise a socket portion of the positive electrode extender, said socket portion being defined by a closed loop adapted to receive in tight-fitting electrically-conducting contacting relation, the positive electrode, which loop, for use, is orientated such that its opening presents towards the positive electrode, and urged between the electrode leg and the positive electrode, to widen the space between the positive electrode and the electrode leg and allow the positive electrode to enter the loop, whereupon the electrode leg springs back to provide for said snap-fit engagement.

According to another aspect of the invention, in the adapter for use with a spark plug and an engine block, for use, the loop can be urged towards the one arm of the electrode leg.

According to another aspect of the invention, the adapter for use with a spark plug and an engine block can further comprise an insulator disposed between and secured to each of the positive and ground electrode extenders.

According to another aspect of the invention, in the adapter for use with a spark plug and an engine block, the ground electrode extender can project axially beyond the positive electrode extender.

According to another aspect of the invention, the insulator can be porcelain.

A spark plug for use with an engine block forms another aspect of the invention. This spark plug comprises: a metal tube which is orientated coaxially about and defines a longitudinal axis and is externally-threaded for engagement in a corresponding threaded bore in said engine block in use; an insulator having a portion disposed inside the tube, which portion extends axially beyond the tube; a positive electrode extending through the insulator and projecting beyond the portion of the insulator that extends beyond the tube; and a ground electrode coupled to the metal tube. In this spark plug, the positive and ground electrodes are configured such that a spark gap defined between the positive and ground electrodes comprises an elongate channel which opens axially and away from said insulator and is substantially unobstructed in the axial direction.

According to other aspects of the invention, the ground electrode can be annular and can define a void having: a central portion which is occupied by the positive electrode in use; an annular channel surrounding the central portion; and a plurality of lobes, each being positioned with respect to the central portion in a manner analogous to the placement of the planet gears with respect to the sun gear in a planetary gear.

According to another aspect of the invention, the plurality of lobes can consist of seven lobes.

According to other aspects of the invention, if

R1 is the radius of each planet gear

R2 is the distance from the axis of each planet gear to the axis of the sun gear R3 is the outer radius of the ground electrode R4 is the outer radius of the annular channel R1:R2:R3:R4:R5 can be about 0.12:0.305:0.475:0.25

The invention relates to the production of spark plugs having spark gap geometries characterized by the presence of at least one elongate channel which opens axially and away from the spark plug body and is substantially unobstructed in the axial direction. Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF DESCRIPTION OF THE DRAWINGS

FIG. 54 is a perspective view of a ground electrode according to another exemplary embodiment of the invention;

FIG. 55 is a plan view of the structure of FIG. 54; and

FIG. 56 is a side view of the structure of FIG. 54.

DETAILED DESCRIPTION

Figure 1:
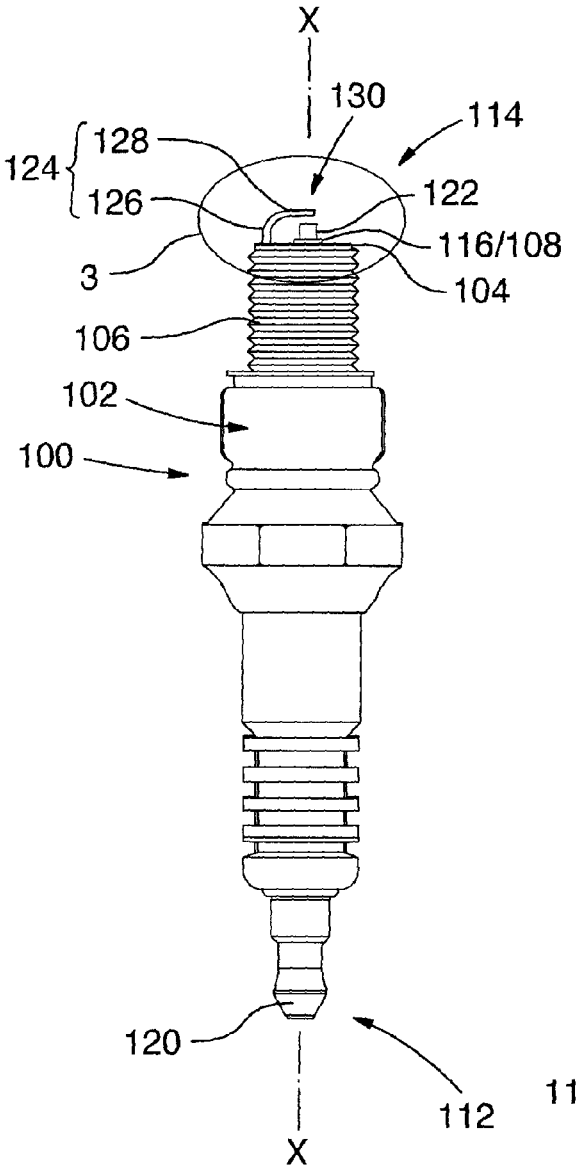
FIG.1 PRIOR ART
FIG. 1 is a side elevational view of a spark plug according to the prior art.
Figure 2:
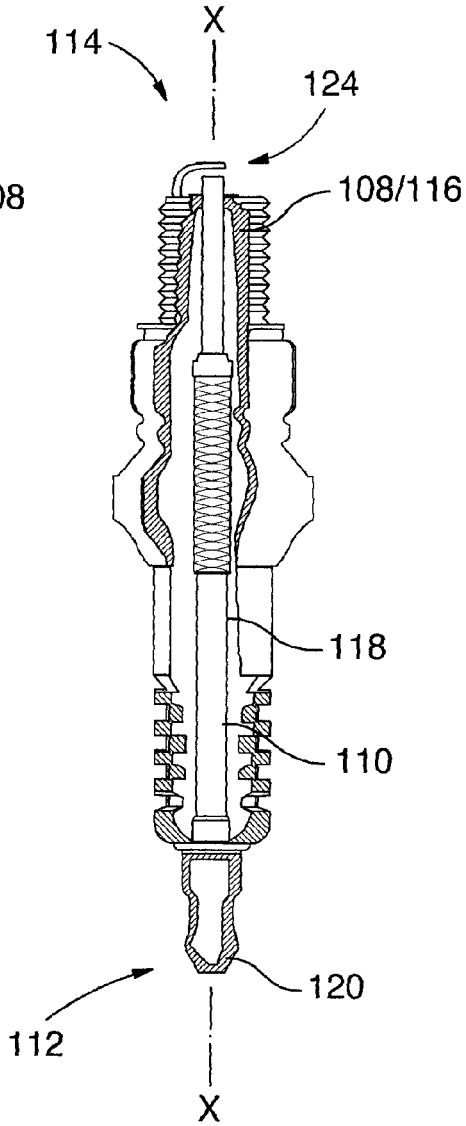
FIG.2 PRIOR ART
FIG. 2 is a cross-sectional view of the spark plug of FIG. 1.

By way of background, a spark plug 100 according to the prior art is illustrated in side elevation in FIG. 1 and in cutaway in FIG. 2 and will be seen to include a plug body 102 and an electrode leg 124.

The plug body 102 defines a longitudinal axis X-X and has a metal ring 104, a metal tube 106, an insulator 108 and an elongate positive electrode 110. Metal ring 104 is adjacent one end 114 of the plug body 102 and is orientated coaxially with the longitudinal axis X-X. The metal tube 106 is orientated coaxially with the longitudinal axis X-X, extends from the ring 104 towards the other end 112 of said body 102 and is externally-threaded for engagement in a corresponding threaded bore in said engine block in use (not shown). The insulator 108 has a portion 116 disposed inside the tube 106, which portion 116 extends axially, from inside the tube 106, beyond the ring 104, and has an elongate void 118 extending axially therethrough. The positive electrode 110 occupies the void and extends, from a terminal 120 at the other end 112 of the body 102, axially beyond the insulator 108 to a terminus 122 which defines the one end 114 of said body 102. The electrode leg 124 has two arms 126,128 transversely connected to one another, with one arm 126 extending axially from the ring 104 and beyond the electrode 110 and the other arm 128 extending radially inwardly from the one arm 126 so as to terminate in an end portion 130 that is axially-spaced from the terminus 122.

Against this backdrop, a method of producing a spark plug according to an exemplary embodiment of the present invention is hereinafter described.

Figure 3:
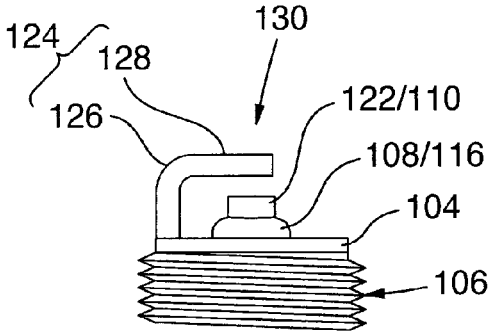
FIG.3 PRIOR ART
FIG. 3 is an enlarged view of encircled area 3 in FIG. 1.
Figure 4:
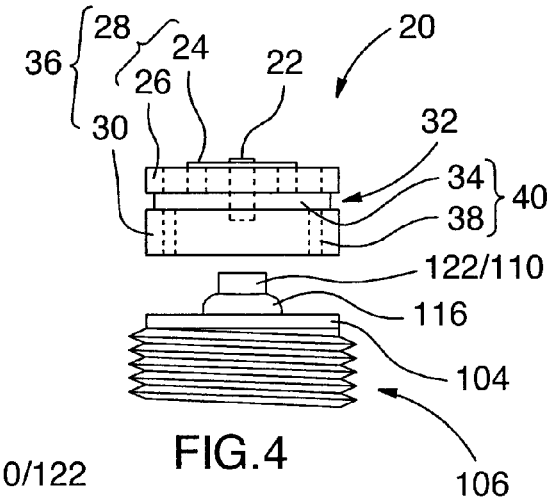
FIG. 4 is a view, showing an adapter according to one embodiment of the invention disposed above an exemplary spark plug body with which it is deployed in use.

In the method, a conventional spark plug body is utilized, as will be evident upon comparison of FIG. 4, which shows an initial step in the method, against FIG. 3, which shows a view of encircled area 3 in FIG. 1.

The spark plug body 102 utilized in this exemplary embodiment may be obtained by removing the electrode leg from a conventional spark plug, procured, for example, through automotive supply retailers. Alternatively, the spark plug body 102 may, for example, be obtained via a custom order from a spark plug manufacturer.

Figure 5:
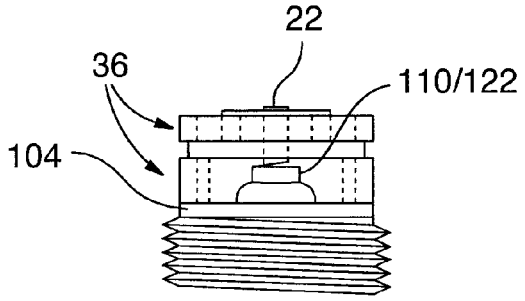
FIG. 5 is a view of the adapter of FIG. 4 in use.
Figure 6:
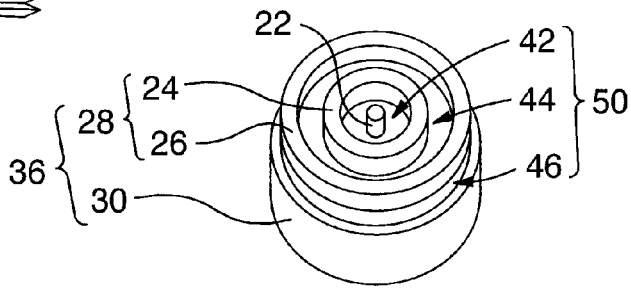
FIG. 6 is a perspective view of the adapter of FIG. 4.

In addition to the spark plug body, the method involves the use of an adapter 20, such as that shown in FIGS. 4-6 by way of example. The adapter 20 comprises a positive electrode extender 22 (shown partially in phantom in FIGS. 4 and 5) and a ground electrode extender 36.

Once a suitable spark plug body and an adapter have been obtained, the exemplary method comprises the step of securing the adapter 20 to the spark plug body 102. In the adapter 20 shown in FIGS. 3-6, the ground electrode extender 36 comprises a fixed portion 30 that is welded to the ring 104, to provide for said securement, as shown in FIG. 5.

Once secured, positive electrode extender 22 is in electrically-conducting contacting relation to positive electrode 110 and ground electrode extender 36 is in electrically-conducting contacting relation to the metal ring 104.

In the adapter illustrated in FIGS. 4-6, the fixed portion 30 is a tube-like extension of the ring 104, the positive electrode extender 22 is a rod-like extension of the terminus 122 and a remote portion 28 and an insulator 40 are provided as part of the adapter 20. The remote portion 28 is spaced apart from the fixed portion 30 and from ring 104 and takes the form of an inner ring 24 and an outer ring 26. The inner ring 24 is disposed about and in spaced relation to the positive electrode extender 22 and orientated coaxially with the longitudinal axis X-X. The outer ring 26 is disposed about and in spaced relation to the inner ring 24, orientated coaxially with the longitudinal axis X-X and disposed in spaced relation to the fixed portion 30.

As shown in FIGS. 4 and 5, the positive electrode extender 22 projects axially beyond the inner ring 24 and the inner ring 24 projects axially beyond the outer ring 26.

The insulator 40 comprises an annular disc portion 34, through which the positive electrode extender 22 passes and which is disposed between: the fixed portion 30; and the inner 24 and outer 26 rings. The outer diameter of annular disc portion 34 is smaller than the outer diameter of the outer ring 26, to define an annular channel 32 between the outer ring 26 and the fixed portion 30. As best seen in FIG. 4, the insulator 40 further includes a tubular boss portion 38, which is engaged in snug-fitting relation inside the fixed portion 30, to secure the annular disc portion 34 to the fixed portion 30. The inner 24 and outer 26 rings are secured to the insulator 40 in any conventional manner.

In this arrangement, a spark gap 50 defined between the positive 22 and ground 36 electrode extenders comprises:

- an annular channel 42 between the positive electrode extender 22 and the inner ring 24, which opens axially and away from the body 102 and is substantially unobstructed in the axial direction;
- an annular channel 44 between the inner ring 24 and the outer ring 26, which opens axially and away from the body 102 and is substantially unobstructed in the axial direction; and
- the annular channel 46 defined between the outer ring 26 and the fixed portion 30.

Figure 7:
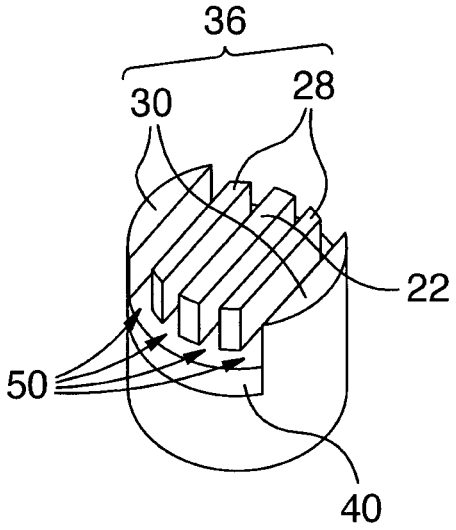
FIG. 7 is a perspective view of an adapter according to another exemplary embodiment of the invention.
Figure 8:
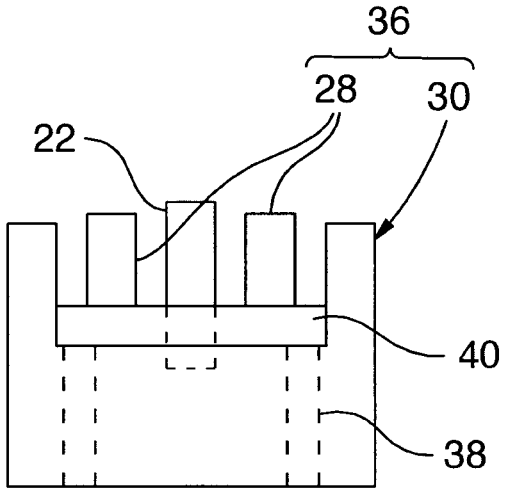
FIG. 8 is a side elevational view of the adapter of FIG. 7.
Figure 9:
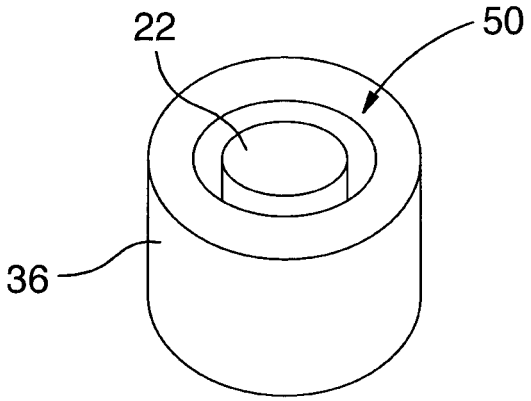
FIG. 9 is a perspective view of an adapter according to another exemplary embodiment of the invention.
Figure 10:
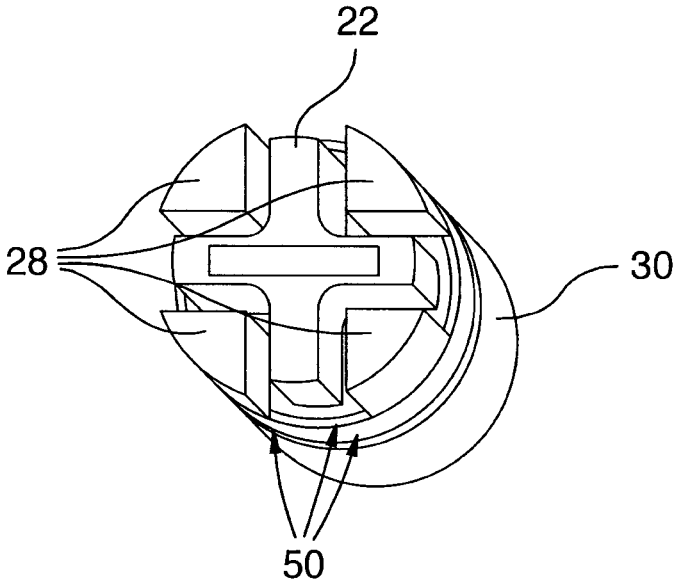
FIG. 10 is a perspective view of an adapter according to another exemplary embodiment of the invention.
Figure 11:
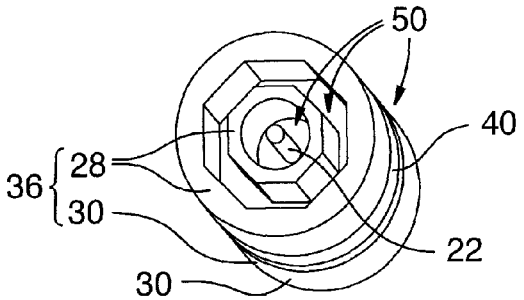
FIG. 11 is a perspective view of an adapter according to another exemplary embodiment of the invention.
Figure 12:
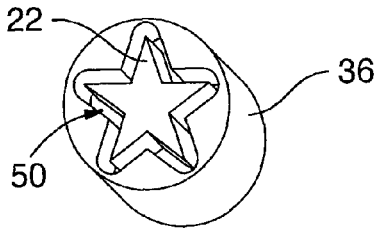
FIG. 12 is a perspective view of an adapter according to another exemplary embodiment of the invention.
Figure 13:
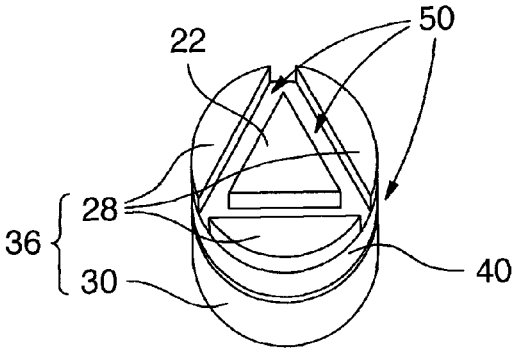
FIG. 13 is a perspective view of an adapter according to another exemplary embodiment of the invention.
Figure 14:
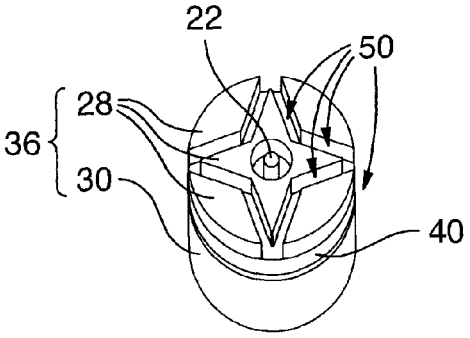
FIG. 14 is a perspective view of an adapter according to another exemplary embodiment of the invention.
Figure 15:
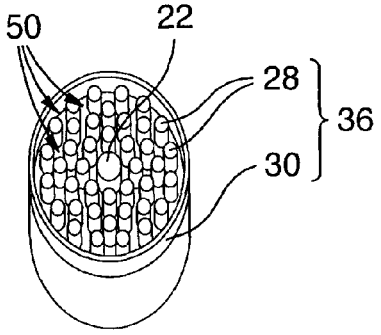
FIG. 15 is a perspective view of an adapter according to another exemplary embodiment of the invention.

Another adapter is shown in FIGS. 7-8. This adapter is generally similar to the adapter shown in FIGS. 3-6, but herein:

- the positive electrode extender 22 comprises a radially-extending bar
- the ground electrode extender 36 comprises four elongate electrode portions, each orientated parallel to the positive electrode extender, with two of the elongate portions disposed on each radial side of the bar and spaced with respect to the bar and one another such that the spark gap 50 comprises four parallel channels, the innermost pair of flanking electrode portions defining the remote portion 28 of the ground electrode extender and the outermost pair of flanking electrode portions forming part of fixed portion 30 of the negative electrode extender 36
- the insulator 40 is disposed between and secured to each of: the fixed portion of the ground electrode extender; and the radially extending bar and the remote portion of the ground electrode extender
- the radially extending bar 22 projects axially beyond the remote portion 28 of the ground electrode extender 36
- the remote portion 28 projects axially beyond the fixed portion 30

Seven further embodiments of this adapter are shown in FIGS. 9-15, the parts thereof being identified in analogous fashion to the adapters illustrated in FIGS. 4-8, but as these adapters are similar in structure and function, further description herein is neither necessary nor provided.

Figure 16:
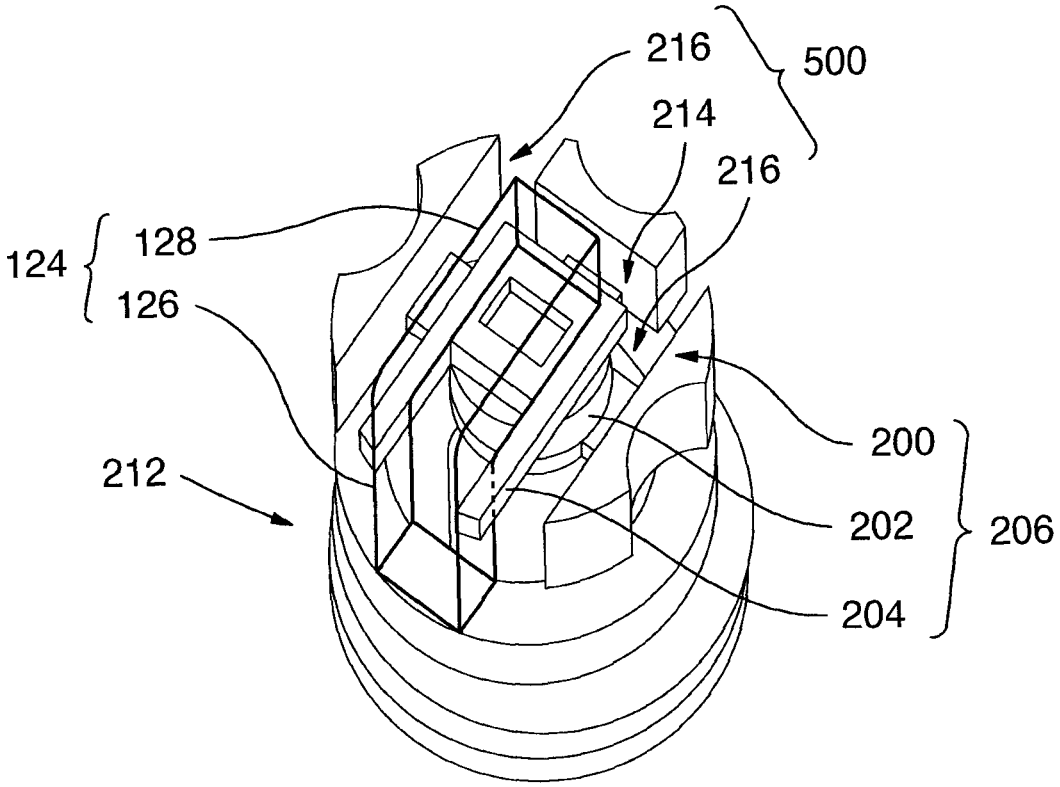
FIG. 16 is a perspective view of an adapter according to another exemplary embodiment of the invention.

In another exemplary embodiment, the invention can be carried out with a conventional spark plug, i.e. which includes the electrode leg. An example of an adapter 206 used in this embodiment is illustrated in snap-fit engagement with a conventional spark plug 212 in FIG. 16 and comprises: a positive electrode extender 200 which, in use, is in electrically-conducting contacting relation to the positive electrode 110/122; and a ground electrode extender 204 which, in use, is in electrically-conducting contacting relation to the electrode leg 124. Adapter 206 is again configured, as per the previous embodiments, such that a spark gap 500 defined between the positive 200 and ground 204 electrode extenders comprises an elongate channel which opens axially away from the body and is substantially unobstructed in the axial direction, and in fact, three elongate channels 214,216,216 are shown in FIG. 16, two 216 flanking the other arm 128 of the electrode leg 124 and one 214 disposed opposite the one arm 126.

Figure 17:
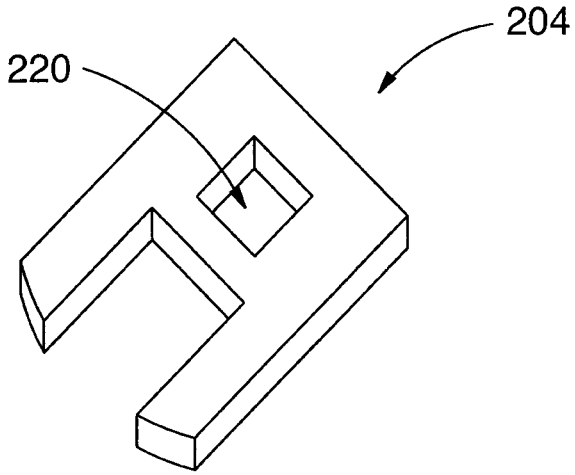
FIG. 17 is a perspective view of a portion of the structure of FIG. 16.
Figure 19:
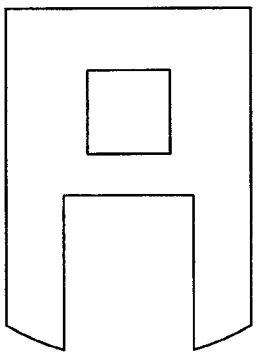
FIG. 19 is a plan view of the structure of FIG. 17.
Figure 18:
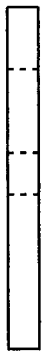
FIG. 18 is a side elevational view of the structure of FIG. 17.
Figure 20:
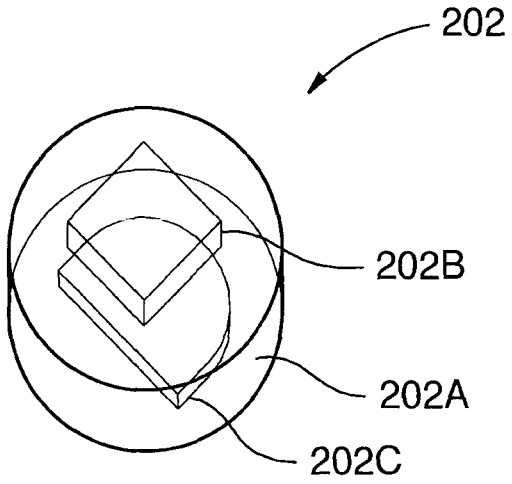
FIG. 20 is a perspective view of another portion of the structure of FIG. 16.
Figure 21:
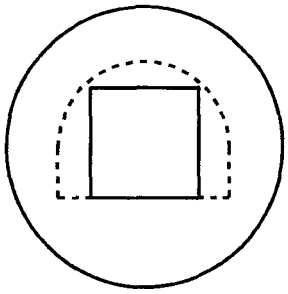
FIG. 21 is a plan view of the structure of FIG. 20.
Figure 22:
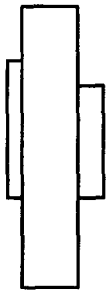
FIG. 22 is a side elevational view of the structure of FIG. 20.
Figure 25:
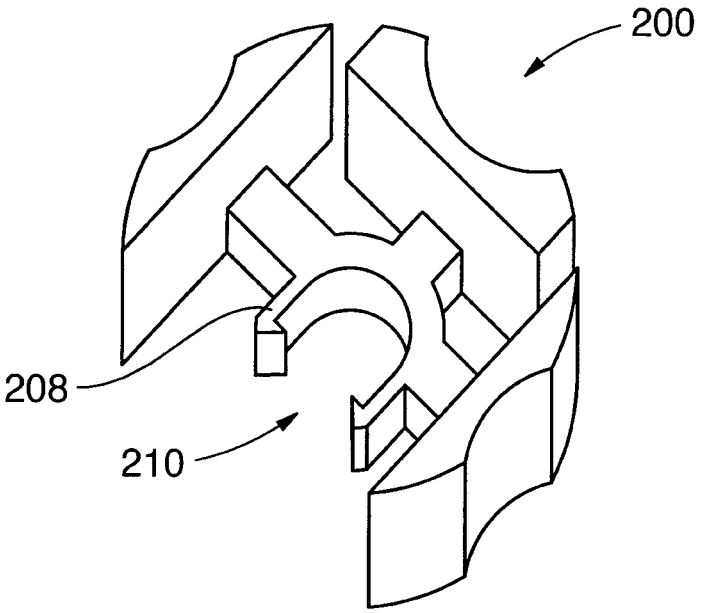
FIG. 25 is a plan view of the structure of FIG. 23.
Figure 23:
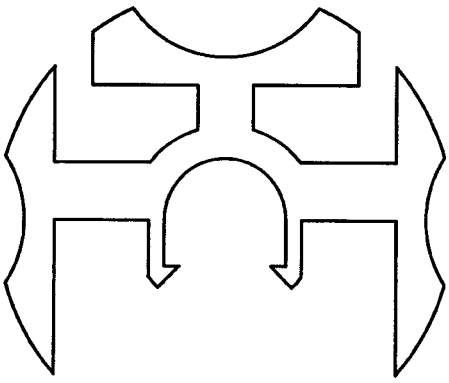
FIG. 23 is a perspective view of a yet further portion of the structure of FIG. 16.
Figure 24:
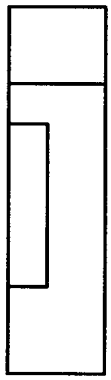
FIG. 24 is a side elevational view of the structure of FIG. 23.
Figure 26:
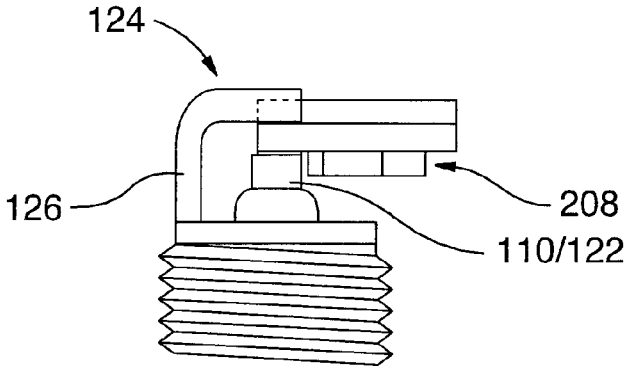
FIG. 26 is a schematic side elevational view of an adapter according to a further embodiment of the invention disposed adjacent an exemplary spark plug with which it is deployed in use.
Figure 28:
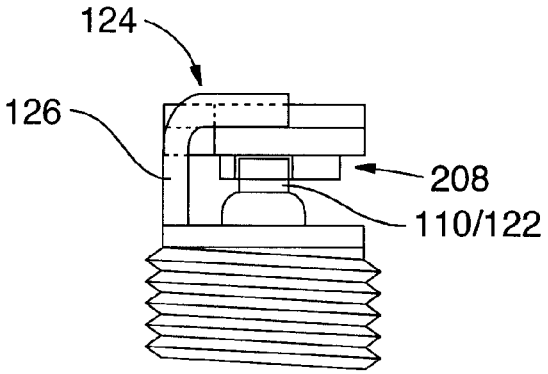
FIG. 28 is a view of the structure of FIG. 26, with the adapter disposed in snap-fit engagement with the positive electrode.
Figure 27:
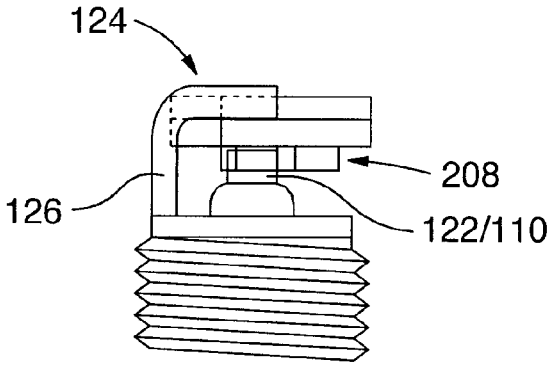
FIG. 27 is a view of the structure of FIG. 26 with the adapter translated radially towards the electrode leg.
Figure 29:
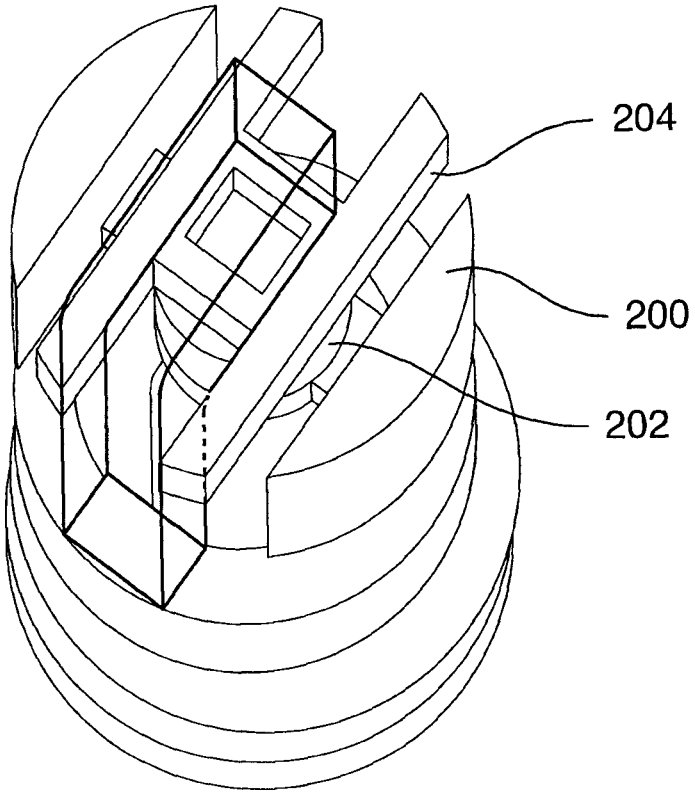
FIG. 29 is a perspective view of a further embodiment of the adapter of the snap-fit type illustrated schematically in FIG. 26-28.
Figure 30:
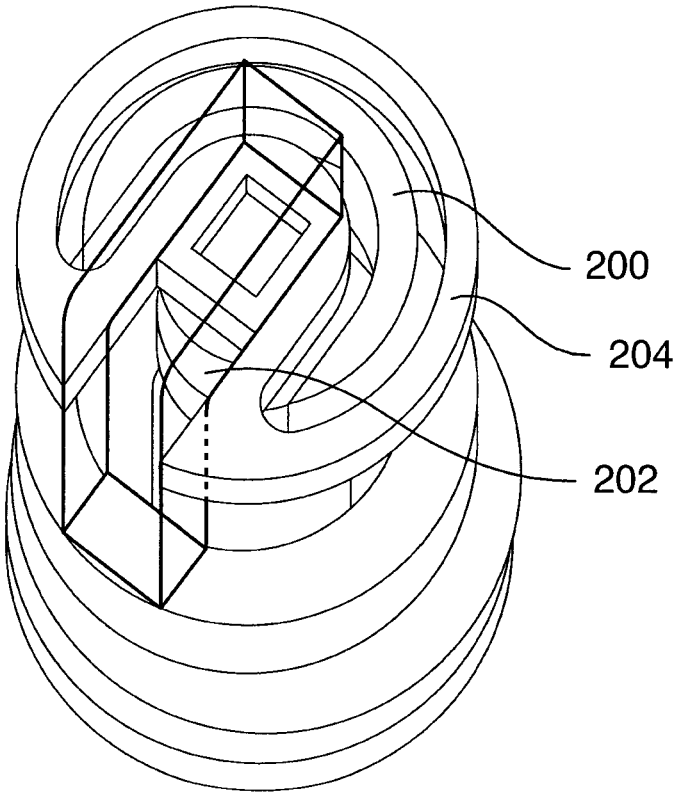
FIG. 30 is a perspective view of a further embodiment of the adapter of the snap-fit type.
Figure 31:
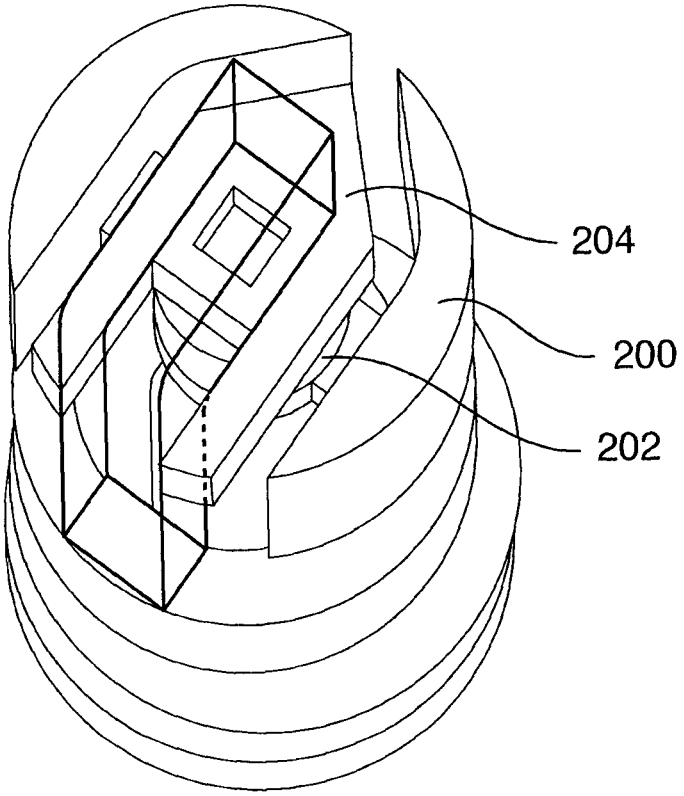
FIG. 31 is a perspective view of a further embodiment of the adapter of the snap-fit type.
Figure 32:
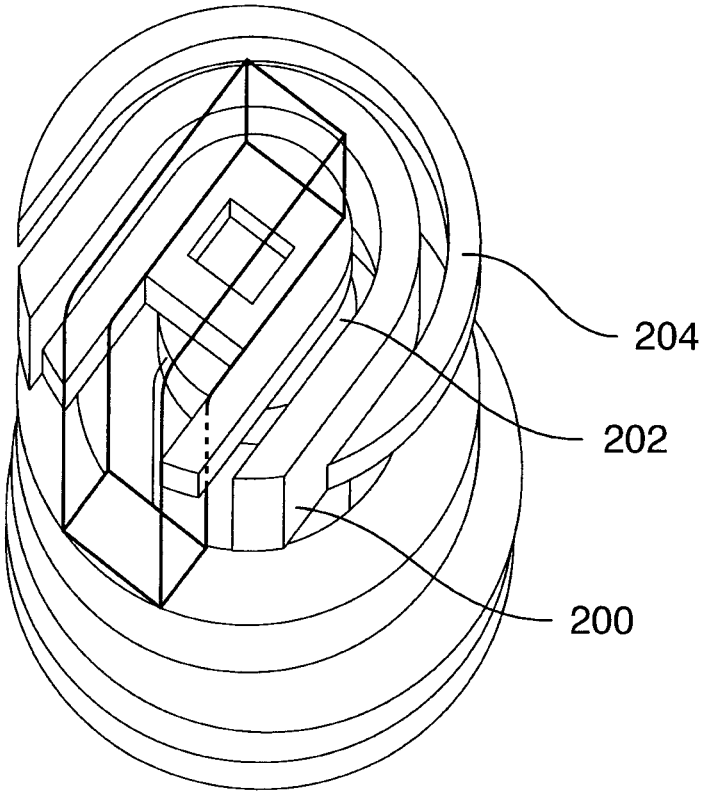
FIG. 32 is a perspective view of a further embodiment of the adapter of the snap-fit type.
Figure 33:
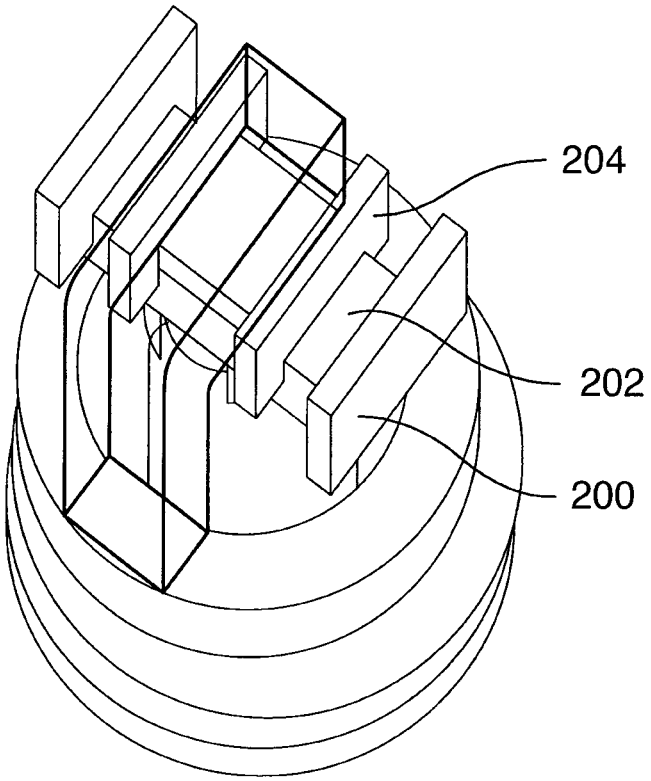
FIG. 33 is a perspective view of a further embodiment of the adapter of the snap-fit type.
Figure 34:
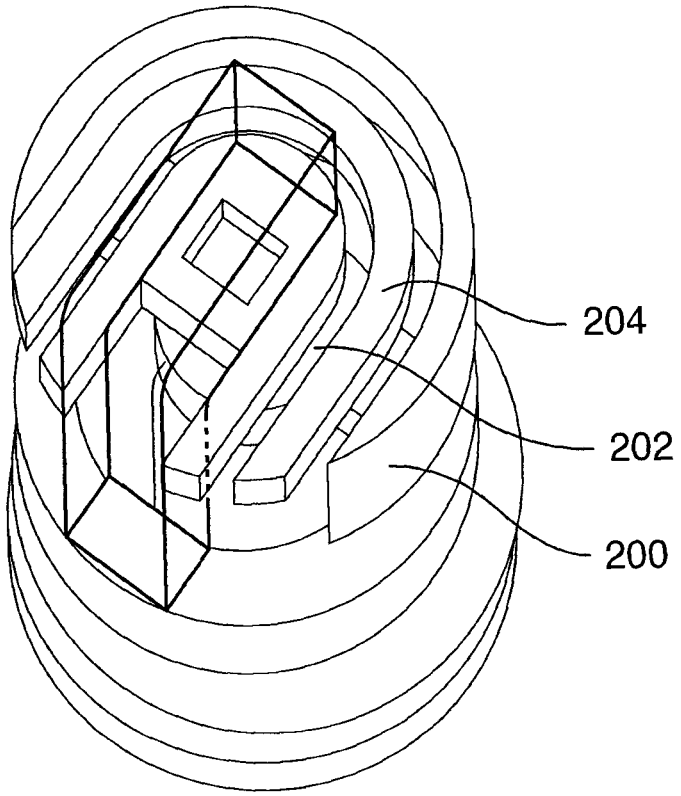
FIG. 34 is a perspective view of a further embodiment of the adapter of the snap-fit type.
Figure 35:
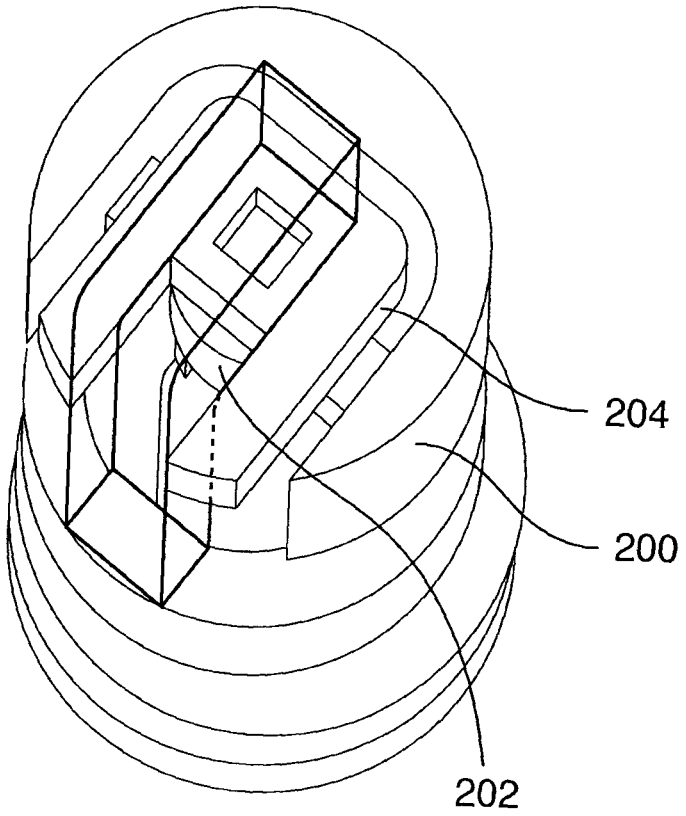
FIG. 35 is a perspective view of a further embodiment of the adapter of the snap-fit type.
Figure 36:
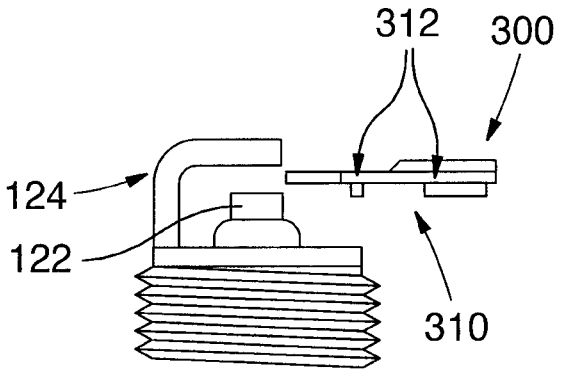
FIG. 36 is a schematic side elevational view of an adapter according to a further embodiment of the invention disposed adjacent an exemplary spark plug with which it is deployed in use.
Figure 37:
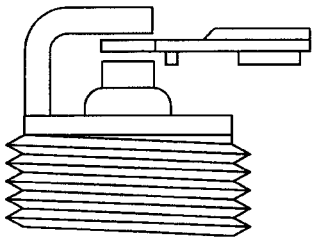
FIG. 37 is a view of the structure of FIG. 36 with the adapter translated radially towards the electrode leg.
Figure 38:
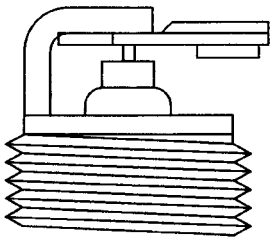
FIG. 38 is a view of the structure of FIG. 37 with the adapter translated further radially towards the electrode leg.
Figure 39:
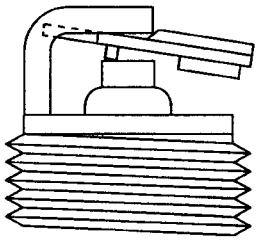
FIG. 39 is a view similar to FIG. 38 with the adapter tilted slightly to permit the positive electrode to partially enter the closed loop.
Figure 40:
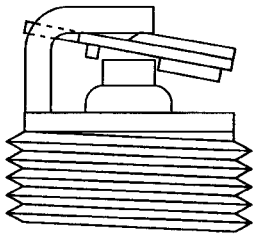
FIG. 40 is a view similar to FIG. 39, with the adapter urged radially further towards the electrode leg, and the electrode leg displaced axially.
Figure 41:
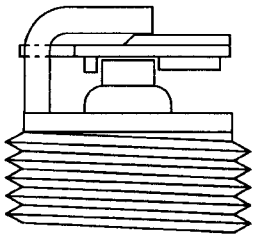
FIG. 41 is a view of the structure of FIG. 40, with the adapter disposed in socketed engagement with the positive electrode.
Figure 42:
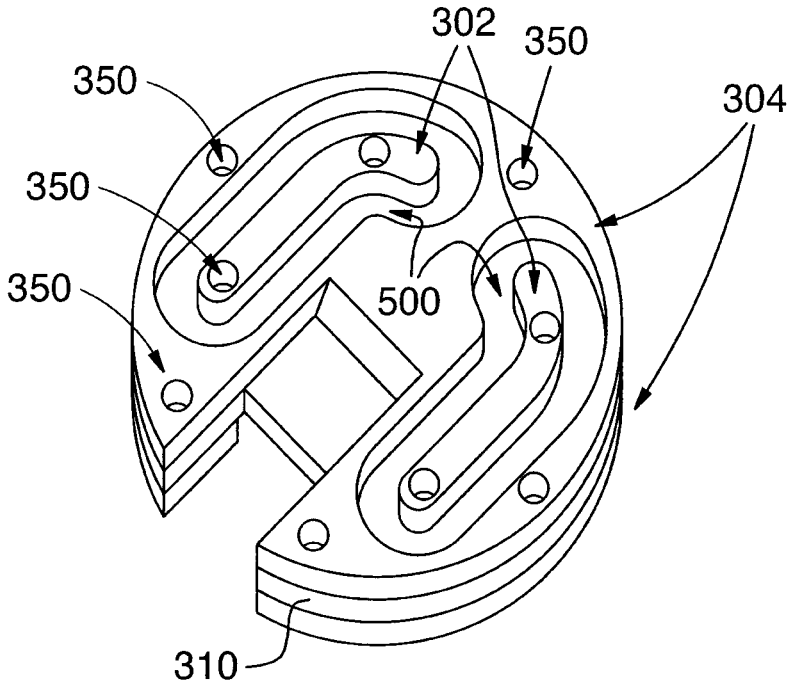
FIG. 42 is a top perspective view of an exemplary adapter of the ring-lock type illustrated schematically in the sequence of FIGS. 36-41.
Figure 43:
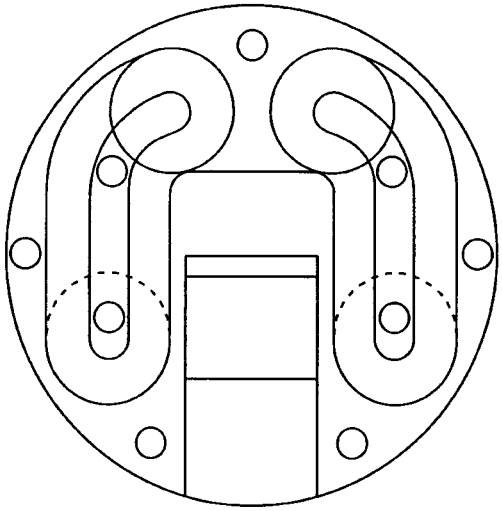
FIG. 43 is a top plan view of the adapter of FIG. 42.
Figure 44:
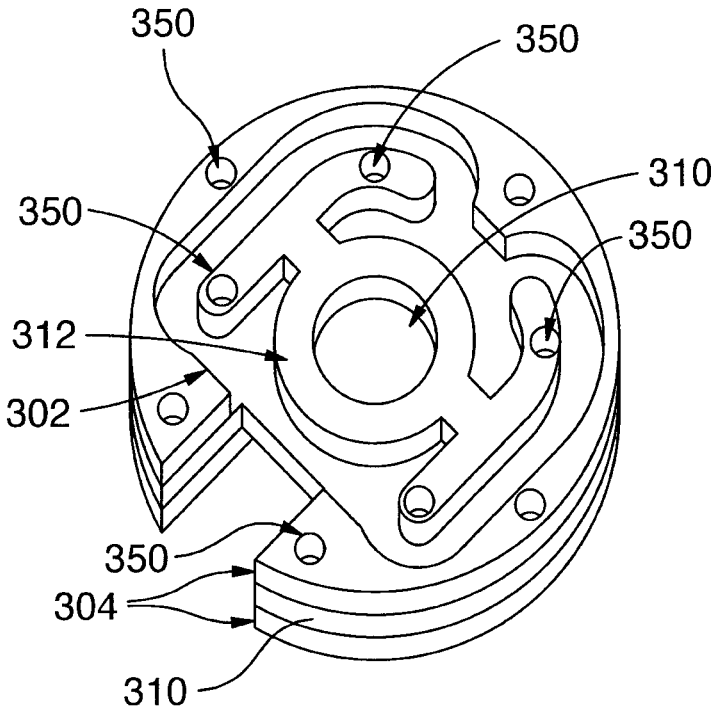
FIG. 44 is a bottom perspective view of the adapter of FIG. 42.
Figure 45:
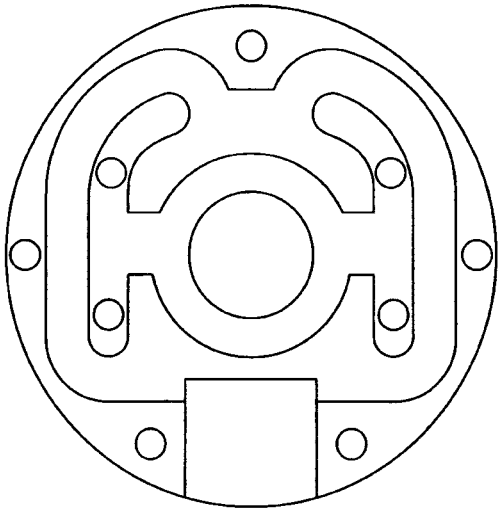
FIG. 45 is a bottom plan view of the adapter of FIG. 42.
Figure 46:
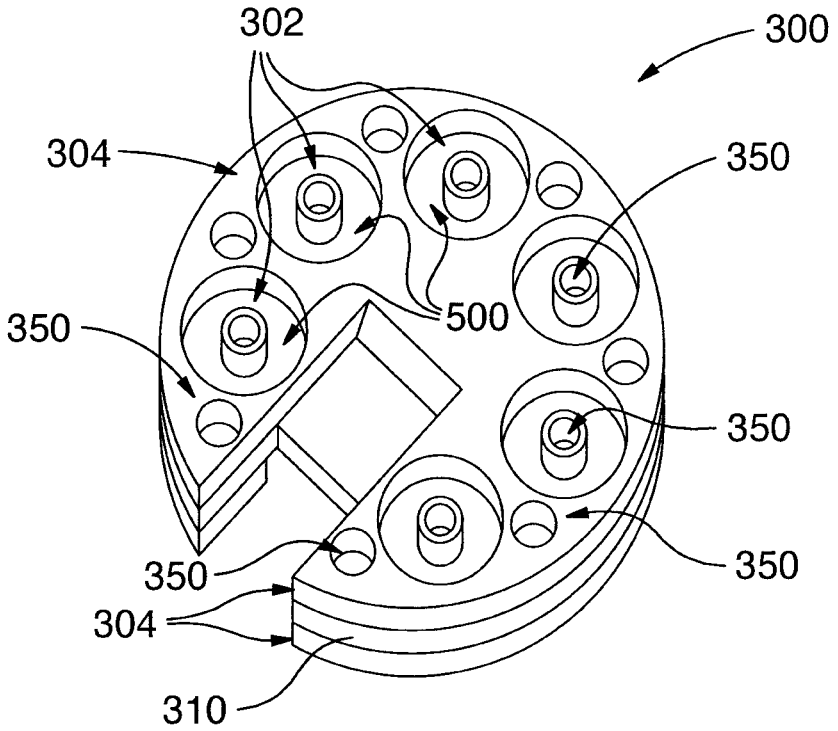
FIG. 46 is a top perspective view of another exemplary adapter of the ring-lock type.
Figure 47:
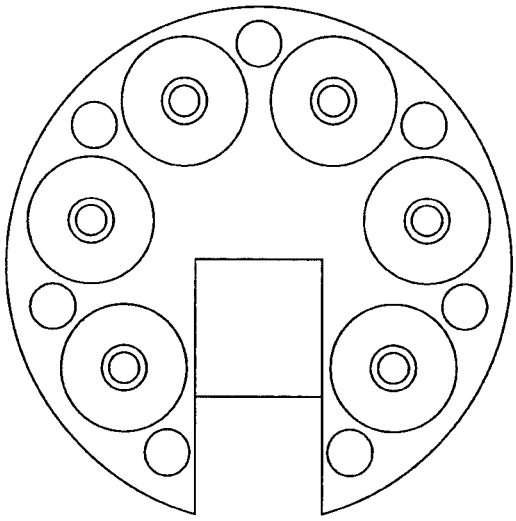
FIG. 47 is a top plan view of the adapter of FIG. 46.
Figure 48:
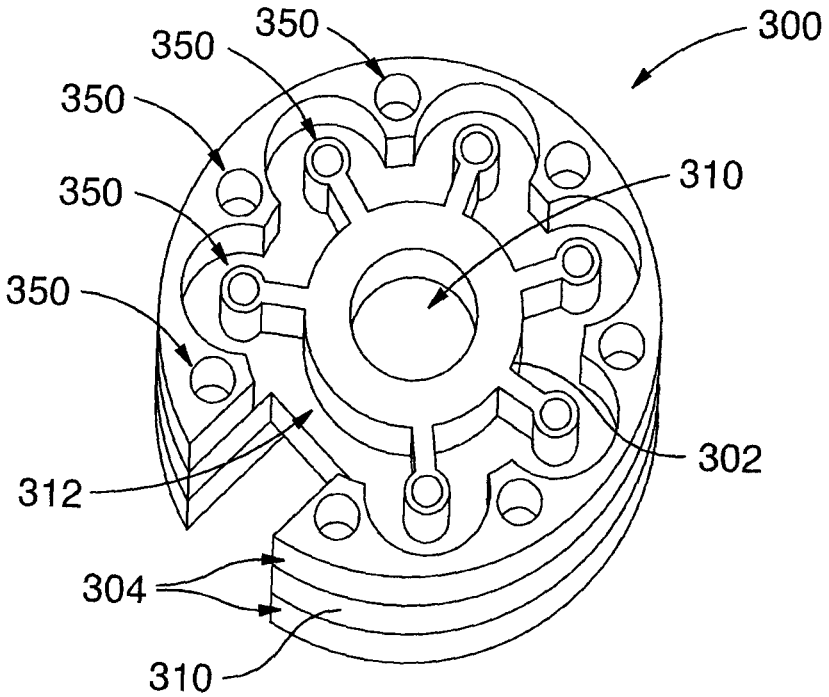
FIG. 48 is a bottom perspective view of the adapter of FIG. 46.
Figure 49:
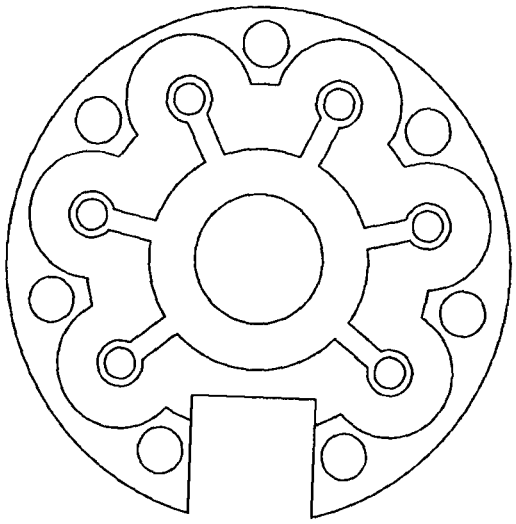
FIG. 49 is a bottom plan view of the adapter of FIG. 46.
Figure 50:
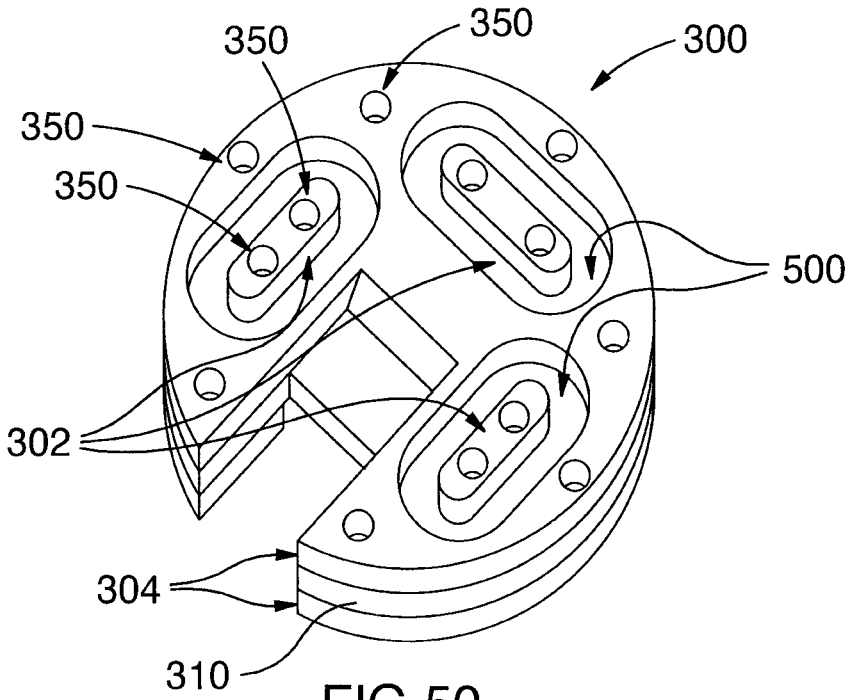
FIG. 50 is a top perspective view of a further exemplary adapter of the ring-lock type.
Figure 51:
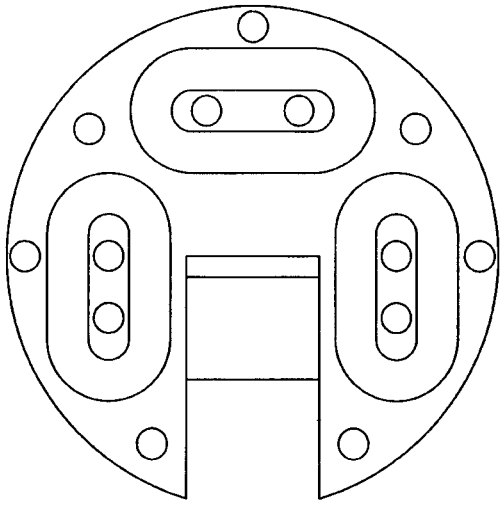
FIG. 51 is a top plan view of the adapter of FIG. 50.
Figure 52:
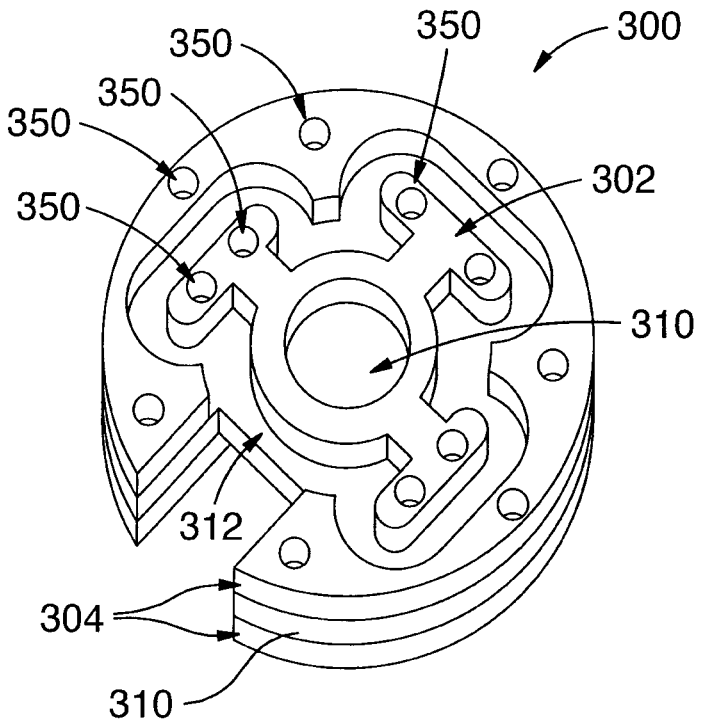
FIG. 52 is a bottom perspective view of the adapter of FIG. 50.
Figure 53:
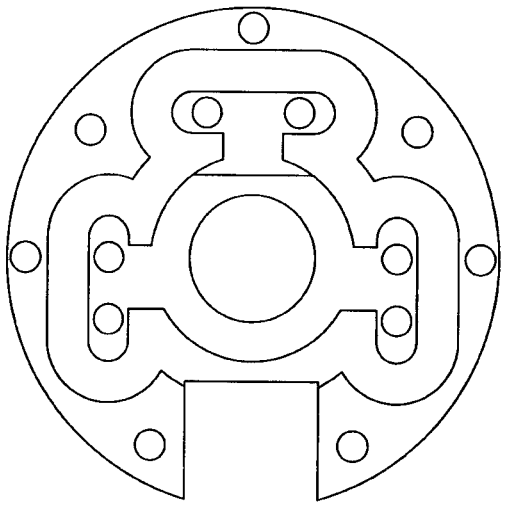
FIG. 53 is a bottom plan view of the adapter of FIG. 50.

FIGS. 17-25 show the components of the adapter 206 in more detail, and with reference to FIGS. 23-25, it will be seen that the positive electrode extender 200 comprises a resilient clip portion 208, said clip portion being defined by an open loop which has an opening 210 smaller than the diameter of the positive electrode 110/122, which loop 208, for use, is orientated such that its opening 110 presents towards the positive electrode 110/122 and urged radially between the electrode leg 124 and the positive electrode 122, as shown schematically by the sequence of FIGS. 26-28, to allow the positive electrode 110/122 to enter the loop 208 and provide for said snap-fit engagement. With further reference to FIGS. 23-25, it is notable that the clip portion 208 defines a generally D-shaped opening. FIGS. 17-19 show the ground electrode extender 204 of this adapter 206, which is notable for its general "A" shape, and for a square central opening 220. FIGS. 20-22 show the insulator disc 202, which is notable for a circular central spacer portion 202A, a square plug portion 202B adapted for insertion, in frictionally-engaged relation, into the square central opening 220 of the ground electrode extender 204 and a D-shaped plug portion 202C adapted for insertion, in frictionally-engaged relation, into the D-shaped opening defined by clip portion 208.

Seven further embodiments of this adapter are shown in FIGS. 29-35, the parts thereof being identified in analogous fashion to the adapter illustrated in FIGS. 16-25, but as these adapters are similar in structure and function, further description herein is neither necessary nor provided.

As another alternative utilizing conventional spark plugs, ring-lock type adapters, as hereinafter described, can be provided. In this alternative, the adapter can further comprise a socket portion of the positive electrode extender, said socket portion being defined by a closed loop adapted to receive in tight-fitting electrically-conducting contacting relation, the positive electrode. As shown by the sequence of FIGS. 36-41, which schematically show a ring-lock type adapter 300 being positioned for use, the loop 312, for use, is orientated such that its opening 310 presents towards the positive electrode 122, and urged between the electrode leg 124 and the positive electrode 122, to widen the space between the positive electrode 122 and the electrode leg 124 and allow the positive electrode 122 to enter the loop 312, whereupon the electrode leg 124 springs back to provide for said snap-fit engagement.

FIGS. 42-53 show three exemplary versions of the ring-lock type adapter 300, constructed using printed circuit board technologies, with an insulative substrate 310 plated on both sides with conductive material, electrical contact being provided across the substrate via plated through-holes 350. Each of these versions includes:

- a positive electrode extender 302 of the contemplated type, i.e. including a socket loop 312, which, in use, is in electrically-conducting contacting relation to the positive electrode 122; and
- a ground electrode extender 304 which, in use, is in electrically-conducting contacting relation to the electrode leg 124.

Each of the illustrated positive 302 and ground 304 electrode extenders has portions on both sides of the substrate 310, connected via plated through-holes 350 as previously mentioned, which portions are configured that a spark gap 500 defined between the positive 302 and ground 304 electrode extenders comprises an elongate channel which opens axially away from the body and is substantially unobstructed in the axial direction.

In each of the embodiments illustrated herein, the insulator, i.e. 40/202/310 may comprise porcelain, or other suitable materials, and the positive 22/200/302 and ground 36/204/304 electrode extenders may comprise copper, or other conductive materials.

Testing has been carried out of spark plugs according to the invention. The testing involved the use of a pair of 2007 Chevrolet Silverado Extended Cabs with 4800 Vortec® Engines. Modifications were made to the vehicle fuel tanks, to permit to permit the tanks to be easily drained; otherwise, the vehicles were utilized in "stock" condition (but for the spark plugs of the present invention, as indicated in the table.) In each test, the vehicles were filled with fuel and driven along a controlled access highway along a common route, with cruise-control locked at 100 km/hr. At the completion of the run, the tanks were refilled; the amount of fuel that was required to be added to refill the tank equates to the amount of fuel consumed during the test.

The test results are reproduced below in Table 1:

TABLE 1

| Run | Vehicle | Spark Plug Utilized | Fuel starting Volume (l) | Fuel ending volume (l) | Distance driven (km) |
|---|---|---|---|---|---|
| 1 | Test | FIG. 4-6 | Full | 13.5 | 98 |
| 2 | Control | Stock | Full | 15.1 | 98 |
| 3 | Test | FIGS. 50-53 | Full | 13.4 | 103 |
| 4 | Control | Stock | Full | 15.2 | 103 |
| 5 | Test | FIGS. 42-45 | Full | 13.5 | 98 |
| 6 | Control | Stock | Full | 14.97 | 98 |
| 7 | Test | FIGS. 7-8 | Full | 12.3 | 99.5 |
| 8 | Control | Stock | Full | 14.5 | 99.5 |
| 9 | Test | FIGS. 16-23 | Full | 11.7 | 99 |
| 10 | Control | Stock | Full | 14.97 | 99 |

As evident from the test results, spark plugs according to the invention can have advantageous impacts on fuel mileage. Without intending to be bound by theory, it is believed that this advantage may flow from the presence of spark gap geometries characterized by the presence of at least one elongate channel which opens axially and away from the spark plug body and is substantially unobstructed in the axial direction, in contradistinction, for example, to conventional spark plugs as illustrated in FIGS. 1-2, wherein the spark gap opens radially, and in the axial direction, is substantially entirely obstructed by the electrode leg. Again, without intending to be bound by theory, it is believed that the spark gap geometries of the plugs according to the invention control the potential distribution between the anode and the cathode, and hence the spatial distribution of the field, leading to: a more uniform and radial energy distribution in the discharge; relatively low quenching, and thus a higher local field gradient in the discharge region; and an engineered field profile that provides for a more distributed discharge profile, suitable for coupling to a larger volume of combustion gas, all in comparison to the prior art spark plugs.

Whereas twenty-one exemplary embodiments of the invention are herein illustrated and described, of three general types, it will be evident that further modifications can be made, both in terms of shape/geometry, size and manner of connection.

A yet further variation is shown in FIG. 54-56. This structure, designated with general reference numeral 600, can be used with a spark plug body of the type shown in FIG. 4, i.e. wherein the arm 124 has been removed. This structure is somewhat similar to the prior structures, in that it also defines a spark gap between the positive and ground electrodes in the form of an elongated channel which opens axially and away from said insulator and is substantially unobstructed in the axial direction.

However, this structure differs in the elongated channel is defined by a void having: a central portion 606 which is occupied by the positive electrode in use; an annular channel 604 surrounding the central portion; and a plurality, namely, seven lobes 602, each being positioned with respect to the central portion in a manner analogous to the placement of the planet gears with respect to the sun gear in a planetary gear. In terms of the specific geometry of the illustrated structure, and with reference in part to the notional planetary gear, if:

R1 is the radius of each planet gear

R2 is the distance from the axis of each planet gear to the axis of the sun gear R3 is the outer radius of the ground electrode R4 is the outer radius of the annular channel then R1:R2:R3:R4:R5 is about 0.12:0.305:0.475:0.25

To so use structure 600, it is welded to the ring 104 in a manner such that the structure surrounds the positive electrode terminus 122 in spaced relation. A structure of this type, constructed from 12 GA CRS, and sized to provide a 0.40 mm spark gap, has been extensively tested with a 2011 GMC Sierra 4×4 Crew Cab, with a 4.8 L engine.

The test results are tabulated below in Table 2 and show two types of tests: ROAD type and DYNO type.

In the ROAD type tests, the test vehicle was driven, under similar driving conditions, twice along a common route [a small variation in distance travelled in one of the tests was associated with local road conditions] and measurements of fuel consumption and distance travelled were made.

In the DYNO type test, the vehicle was loaded on a dynamometer and driven from rest at 100 km/hr until the engine reached a predetermined threshold temperature, and measurements of distance travelled and fuel consumed were made.

TABLE 2

| TEST TYPE | PLUG TYPE | ODOMETER START (KM) | ODOMETER END (KM) | DISTANCE (KM) | FUEL CONSUMED (LITRES) | MILEAGE L/100 KM |
|---|---|---|---|---|---|---|
| ROAD | OEM | 11135 | 11179 | 44 | 5.86 | 13.318 |
| ROAD | ACD | 11187 | 11231 | 44 | 3.964 | 8.986 |
| ROAD | ACD | 11363 | 11405 | 42 | 3.86 | 9.190 |
| ROAD | OEM | 11405 | 11447 | 42 | 5.219 | 12.426 |
| ROAD | ACD | 11590 | 11653 | 63 | 6.038 | 9.584 |
| ROAD | OEM | 11653 | 11714 | 61 | 8.065 | 13.221 |
| DYNO | OEM | 12329 | 12351 | 22 | 1.7 | 7.27 |
| DYNO | B + ACD | 12351 | 12376 | 25 | .95 | 3.8 |
| DYNO | ACD | 12376 | 12402 | 26 | 1.3 | 5.0 |
| DYNO | NGK | 13085 | 13111 | 26 | 1.1 | 4.231 |
| DYNO | CHAMPION | 13111 | 13136 | 25 | 1.35 | 5.4 |
| DYNO | ACD | 13136 | 13162 | 26 | 1.0 | 3.846 |

In Table 2, the terms indicated below having the meanings attributed thereto:

OEM means the vehicle was driven with new stock plugs

ACD means the vehicle was driven with new AC/Delco 41-110 iridium spark plugs, ground arms removed and each replaced with the structure of FIGS. 54-56

NGK means the vehicle was driven with new NGK TR55GP Premium Platinum Tip spark plugs, ground arm removed and replaced with the structure of FIGS. 54-56

CHAMPION means the vehicle was driven with new Champion 3983 Platinum Power spark plugs, ground arm removed and replaced with the structure of FIGS. 54-56

B+ACD means the vehicle was driven with 7 new Bosch 18-2920 Platinum Plus and 1 new AC/Delco 41-110 spark plugs, each with ground arm removed and replaced with the structure of FIGS. 54-56

In view of the above, it will be evident that the structure of FIGS. 54-56 also produces a spark plug that can provide significant improvements in fuel efficiency.

Yet further variations are possible. Accordingly, it should be understood that the invention is to be limited only by the accompanying claims, purposively construed.

The invention claimed is:

1. A spark plug for use with an engine block/cylinder head, said spark plug comprising:

a metal tube which is orientated coaxially about and defines a longitudinal axis and is externally-threaded for engagement in a corresponding threaded bore in said engine block in use;

an insulator having a portion disposed inside the tube, which portion extends axially beyond the tube;

a positive electrode extending through the insulator and projecting beyond the portion of the insulator that extends beyond the tube;

a ground electrode coupled to the metal tube, wherein the positive and ground electrodes are configured such that a spark gap defined between the positive and ground electrodes comprises an elongate channel which opens axially and away from said insulator and is substantially unobstructed in the axial direction;

wherein the ground electrode is annular and defines a void having:

a central portion which is occupied by the positive electrode in use;

an annular channel surrounding the central portion;

a plurality of lobes, each being positioned with respect to the central portion in a manner analogous to the placement of the planet gears with respect to the sun gear in a planetary gear;

wherein the plurality of lobes consists of three to seven lobes; and, wherein if R1 is the radius of each lobe R2 is the distance from the axis of each lobe to the axis of the central portion R3 is the outer radius of the ground electrode R4 is the outer radius of the annular channel R1:R2:R3:R4:R5 is about 0.12: 0.305: 0.475: 0.25.

2. A spark plug according to claim 1, wherein the plurality of lobes consists of seven lobes.

* * * * *